United States Patent [19]

Fischer et al.

[11] 4,419,946

[45] Dec. 13, 1983

[54] FEEDING DEVICE FOR AN AUTOMATIC SEWING ARRANGEMENT

[75] Inventors: Jochen Fischer, Detmold; Hans Scholl, Oerlinghausen-Lipperreihe, both of Fed. Rep. of Germany

[73] Assignee: Kochs Adler AG, Bielefeld, Fed. Rep. of Germany

[21] Appl. No.: 415,596

[22] Filed: Sep. 7, 1982

[30] Foreign Application Priority Data

Sep. 17, 1981 [DE] Fed. Rep. of Germany ..... 3136953

[51] Int. Cl.[3] ..... D05B 21/00; D05B 27/00

[52] U.S. Cl. ..... 112/121.12; 112/308

[58] Field of Search ..... 112/121.11, 121.12, 112/121.15, 104, 113, 308, 102

[56] References Cited

U.S. PATENT DOCUMENTS

| | | | |
|---|---|---|---|
| 3,358,626 | 12/1967 | Bryan | 112/308 X |
| 4,160,423 | 7/1979 | Scholl et al. | 112/121.12 |
| 4,282,819 | 8/1981 | Sartor | 112/121.12 |
| 4,347,797 | 9/1982 | Scholl et al. | 112/121.12 |

*Primary Examiner*—H. Hampton Hunter

*Attorney, Agent, or Firm*—Max Fogiel

[57] ABSTRACT

A feeding device for an automatic sewing arrangement for producing a seam of a predetermined contour, in which a link system is provided with two levers and an output lever. To the free end of the output lever there is tiltably mounted a workpiece clamp. The two levers are pivotably supported about a stationary axis in order to be swingably driven. In order to allow universal displacement of the workpiece clamp, the displacement of which is only restricted by the size of the link system, driving devices engage independently from one another the levers. Furthermore, the workpiece clamp may be swingably driven by an electric motor.

12 Claims, 7 Drawing Figures

1
2
3
4
5
6
7
8
9
10
11
12
13
14
15
16
17
18
19
20
21
22
23
24
25
26
27
31
37
38
39
41
45
46
48
49
58
59
62
63
64
65
66
II
III
IV

FEEDING DEVICE FOR AN AUTOMATIC SEWING ARRANGEMENT

BACKGROUND OF THE INVENTION

The present invention relates, in general, to a feeding device for an automatic sewing arrangement for producing a stitch contour in a workpiece according to a predetermined program. A movably arranged workpiece receiving device is controlled with respect to the needle by means of a link system cooperating with a control cam. The link system is installed with two levers tiltably received on an axis of the stand of the sewing arrangement. In particular, new driving devices are proposed for operating the levers of the link system.

In the German laid-open patent application DE-OS 30 00 831, there is described such a sewing arrangement, which is installed essentially with a link system. The two drive levers of the link system are each formed with a cam-following means, each operating with a cam groove provided in the upper and lower side of a rotatably driven control cam. As the control cam rotates for one revolution, the workpiece clamp situated at a drive-off lever of the link system travels in the sewing plane as in a two-dimensional path according to the predetermined program. In the lower side of the control cam there is profiled a further control groove cooperating with an additional lever capable of rotating the workpiece clamp, turnably connected to the drive-off lever, where the lever is operably connected to the workpiece clamp by means of a timing belt drive.

Feeding devices of such construction are well proven in the field due to their simple construction and reliable operation. As all three control grooves are firmly positioned relatively to each other and commonly driven, a desired rotation of the workpiece clamp only also requires some lost space of the other two control grooves controlling the two-dimensional path of the workpiece clamp. Furthermore, the workpiece clamp is limited as to its movements of rotation, as it can only be rotated over a certain angle, that may have a value of 360° at the most. Moreover, the two control grooves situated on one side of the control cam limit themselves in their extension so as to prevent any cross section, i.e. the work area of the workpiece clamp is restricted. In order to achieve the maximum of rotation of 360°, a large gear ratio for rotatably driving the workpiece clamp is required. This makes the drive system sensitive with respect to tolerances of the cam groove's geometry and also exposes the cam follower and the cam groove to increased wear. As the control cam cannot be enlarged without any limit actions, it is possible only to control a program provided with a limited number of stitches. Another shortcoming is represented by the fact that a control cam (once it is manufactured) cannot be altered anymore, so that a correction of a sewing program can be achieved only by replacing the control cam with another one.

In German Patent No. DE-PS 28 18 179 equivalent to U.S. Pat. No. 4,157,686, there is described a feeding device of the aforementioned kind, where the workpiece clamp is firmly connected to the drive-off lever and the control cam may be rotatably driven with different velocities so as to get a maximum sector of the control cam for use of the actual sewing program. This is achieved by the installation of additional drive and control elements.

It is a main object of the present invention to provide the known feeding device with drive elements so as to achieve universal movements of the workpiece clamp which are limited only by the size of the link system.

It is a further object of this invention to provide individual drive elements for each drive lever as to be completely free in controlling the movements of the workpiece clamp.

Another object of the present invention is to create a feeding device having a rotatable workpiece clamp with no limitation as far as the rotation of the workpiece clamp is concerned.

A further object is to minimize the mass of the rotatably driven workpiece clamp.

Another object is to provide an arrangement of the workpiece clamp drive, the movements of which do not interfere with the tilt movements of the levers induced by the drive devices.

Still another object of the present invention is to provide a feeding device with simple controllable drive motors controlled by a central programmable computer.

Still another object of the present invention is to provide a feeding device of the aforesaid character which is simple in construction and reliable in operation.

SUMMARY OF THE INVENTION

The objects of the present invention are achieved by providing individual driving devices at each lever of the link system. This makes possible individual movements of the workpiece clamp. With these driving devices the sewing program is limited only by the size of the link system, and by the storage capacity of the computer.

A simple control of the driving devices is realized by stepper motors or DC motors which are controlled by a central programmable computer. By forming the driving devices with a spindle/nut arrangement or a pinion/gear segment arrangement, a reliable construction is achieved.

With an electro motor at the workpiece clamp, individual movements without any restrictions as to its movements of rotation as well as to its timewise relation to the lever drive devices are made possible. The provision of low inertia timing belts as transmitting elements operably connecting the electro motor with the rotatably arranged workpiece clamp, allows that the electro motor may be stationarily mounted at the stand of the sewing automat thus allowing to minimize the mass of the workpiece clamp to be moved. Furthermore, the arrangement of a timing belt system represents a parallel crank system. Thus, the workpiece clamp is parallelly guided when moved by the link system with respect to itself as the motor controlling the drive movements of the workpiece clamp is kept in position, i.e. stopped, and as the levers of the link system are driven by the driving devices.

Other objects and advantages and features of the present invention will appear from the detailed description of the preferred and modified embodiment, which will now be explained in conjunction with the accompanying drawings.

DESCRIPTION OF THE PREFERRED EMBODIMENTS

Figure 1:
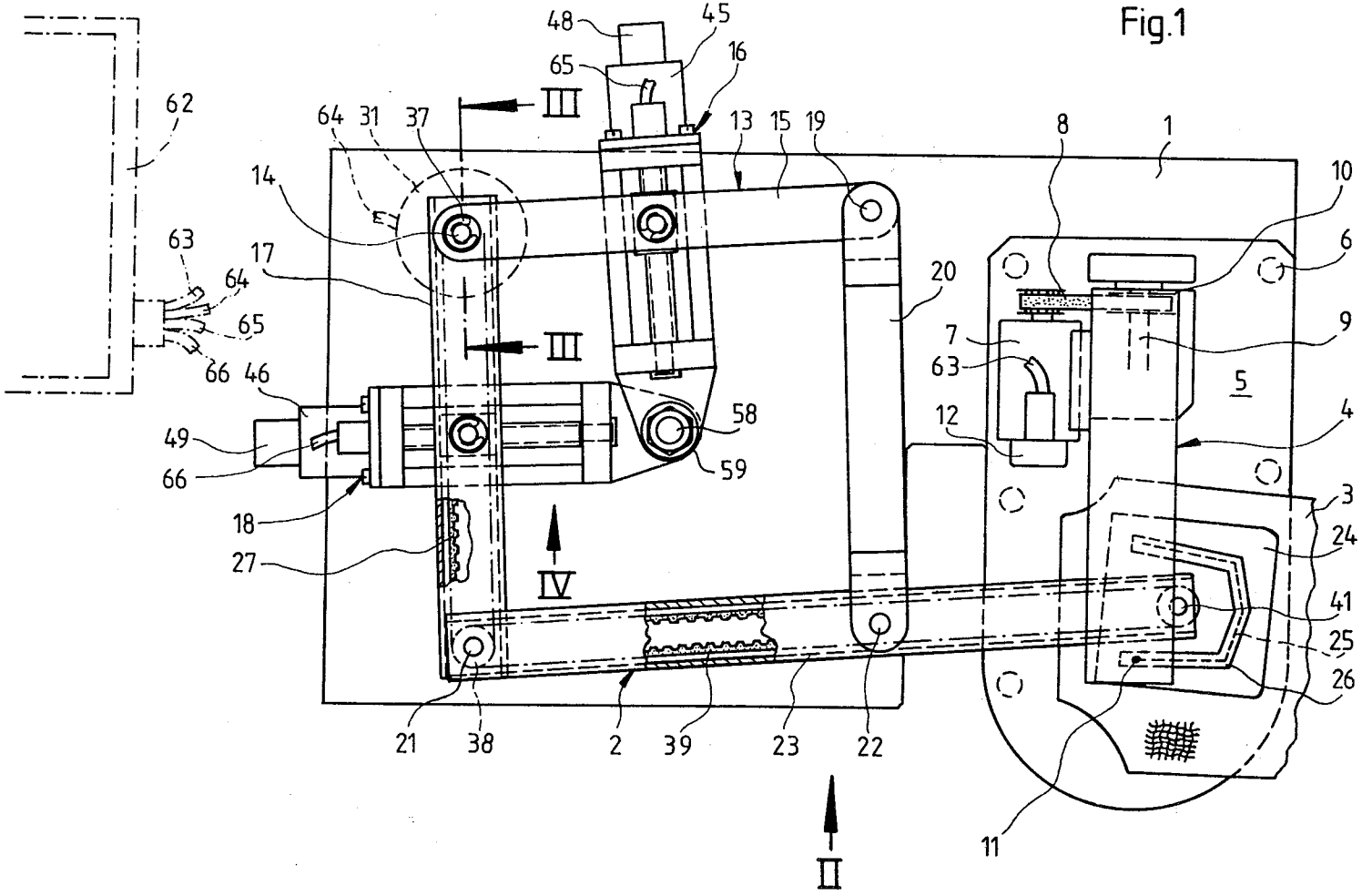
FIG. 1 is a top plan view of an automatic sewing machine with a feeding device according to the present invention.
Figure 2:
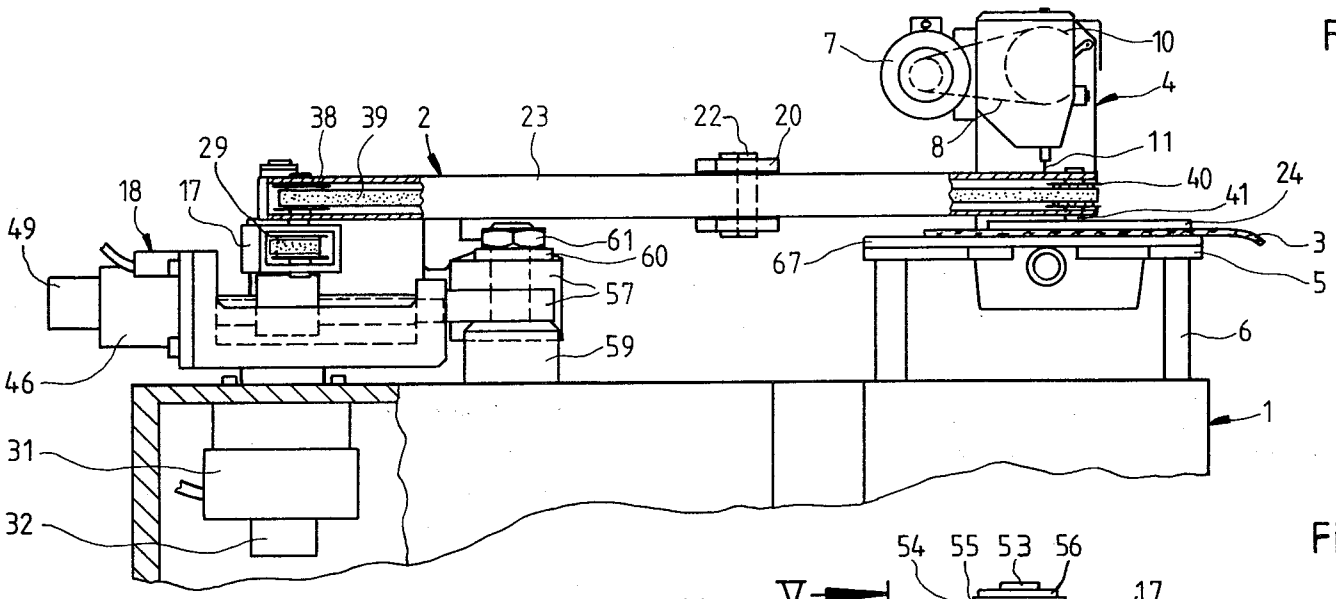
FIG. 2 is a partially broken away side elevation of the automatic sewing machine in the direction of arrow II in FIG. 1.
Figure 4:
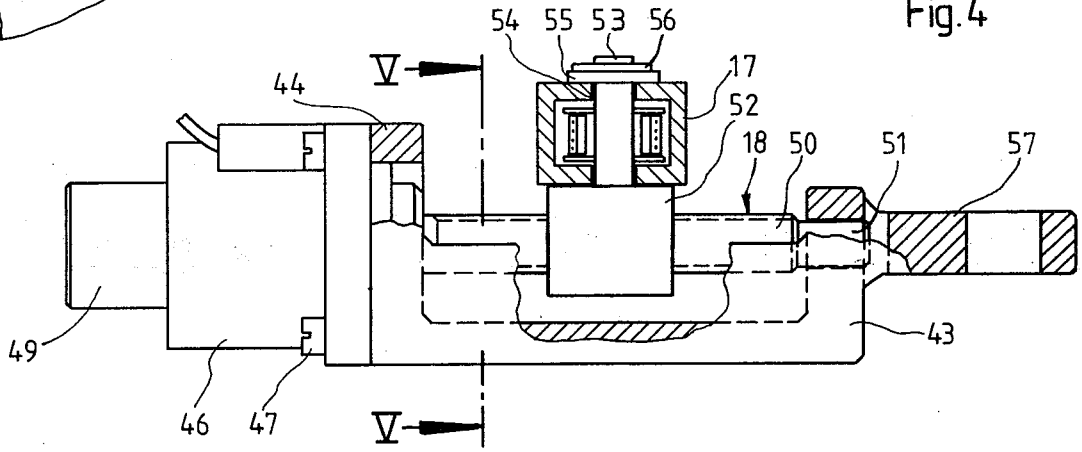
FIG. 4 is a front view of a driving arrangement in the direction of the arrow IV in FIG. 1.
Figure 5:
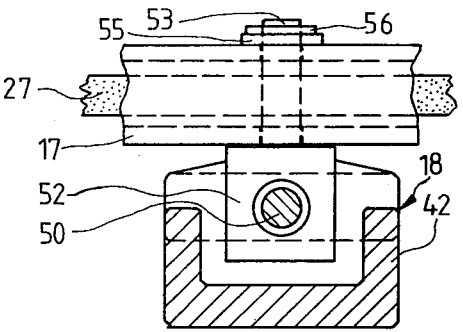
FIG. 5 is a cross section through the driving arrangement taken along line V—V of FIG. 4.
Figure 3:
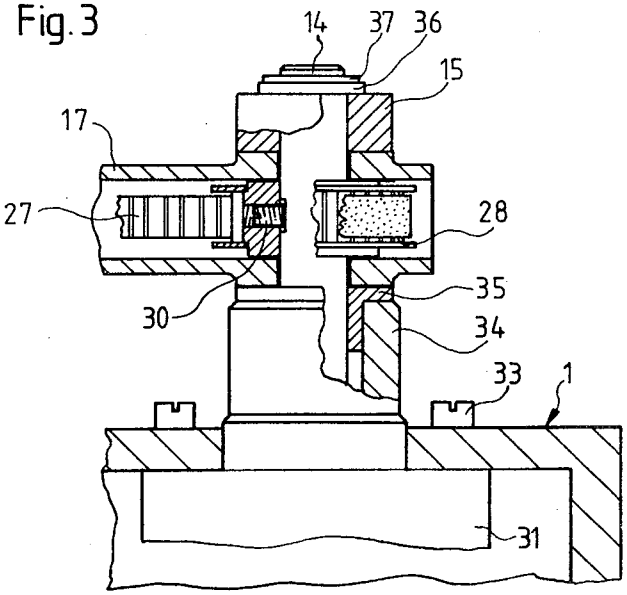
FIG. 3 is a section through a part of the feeding device taken along line III—III of FIG. 1.

FIG. 1 of the drawings refers to an automatic sewing machine having a stand 1 for receiving a feeding device 2 for a workpiece 3 and a sewing machine denoted hereinafter as a sewing head 4. The sewing head 4 is carried by a plate 5 which is supported with respect to the stand 1 by posts 6.

The sewing head 4 is driven by a drive motor 7 via a timing belt 8 which drives a timing belt pulley 10 arranged on an arm shaft 9 of the sewing head 4. The arm shaft 9 drives a needle 11 in the usual manner. A pulse generator 12 is connected to the drive motor 7 and serves as a positioner for the needle 11.

The feeding device 2 is provided with a link system 13 consisting, in principle, of a link quadrangle which comprises a stationary axis of rotation formed by an axis 14. This axis 14 is arranged at the stand 1 and carries a lever 15 extending vertically with respect to the main direction of the sewing head 4 and swingably by means of a driving device 16. A further lever 17 is pivotably received on the axis 14 extending vertically with respect to the lever 15, i.e. parallel with respect to the main direction of the sewing head 4. A driving device 18 engages the lever 17 and is identical with the driving device 16.

To the end of the lever 15 which is turned away from the axis 14, there is hinged, via a link 19, an intermediate lever 20 extending parallel with respect to the lever 17. To the two ends of the lever 17 or the intermediate lever 20 turned away from the axis 14 or the link 19, there is hinged via links 21, 22 an output lever 23, which in turn extends parallel with respect to the lever 15. As evident from the drawings, the lever 15, the intermediate lever 20, and the output lever 23 are positioned in the same plane while the lever 17 is positioned directly below this plane. According to FIG. 1 the link system 13 defined by four joints 14, 19, 21, 22 forms a parallelogram with nearly right angles and equal sides. A workpiece clamp 24 for the workpiece 3 is connected to the free end of the output lever 23 projecting below the sewing head 4. The workpiece clamp 24 is formed with a recess which corresponds with the contour of the seam 25 to be produced. In the present application a pocket shall be sewn onto the workpiece 3. The lever 17 is formed as a box-type bracket for receiving a timing belt 27 which is guided on one hand about a timing belt pulley 28 concentrically arranged with respect to the axis 14, and on the other hand about a timing belt pulley 29 concentrically arranged with respect to the link 21. The timing belt pulley 28 is connected to the axis 14 by means of a set screw 30. The axis 14 in turn serves as an output shaft for an electric motor 31 integrated with a gear box. The electric motor 31 is also provided with a pulse generator 32.

The electric motor 31 is attached to the stand 1 by means of screws 33 and passes with a hollow projection 34 through the stand 1. On the projection 34 there is arranged a bushing 35 for supporting the lever 17 which is freely pivotable on the axis 14. To the lever 17 there is supported the lever 15, which is axially fixed to the axis 14 by means of a washer 36 and a retaining ring 37. Consequently, the levers 15, 17 are freely rotatable or tiltable with respect to the axis 14 serving as a shaft, as the timing belt pulley 28 is firmly connected to the axis 14.

The timing belt pulley 29 is connected to a timing belt pulley 38 by means of an axis simultaneously forming the link 21. The timing belt pulley 38 extends inside of the output lever 23 also formed as a box-type bracket. The timing belt pulley 38 is surrounded by a further timing belt 39, which in turn is guided about a timing belt pulley 40 located in the area of the free end of the output lever 23. The timing belt pulley 40 is connected to an axis of rotation 41, to which is mounted the workpiece clamp 24. On one hand, the timing belt pulleys 28 and 29 and, on the other hand, the timing belt pulleys 38, 40 are each provided with equal diameters, so that, while upon standstill of the timing belt pulley 28, the workpiece clamp 24 together with the workpiece 3 is displaced parallel to itself when the output lever 23 is displaced by displacements of the link system 13. However, when the electric motor 31 is started, the workpiece clamp 24 is displaced about its axis of rotation 41.

As the two driving devices 16 and 18 are identical, they are described hereinafter only once. They are each provided with a U-shaped bracket 42 having at the end extending inwards towards the link system 13, an upstanding rib 43, and at the other end an upstanding flange 44. To the outer surface of the flange 44 there is mounted by means of screws 47 an electric motor 45 or 46. The motors 45, 46 are provided each with a pulse generator 48, 49. To each electric motor 45, 46 there is coupled a spindle 50, which is supported by means of a shoulder 51 in the rib 43. A spindle nut 52 is arranged on the spindle 50 and is provided with an upwardly extending lug 53, which is received in a correspondent bore 54 formed in the levers 17, 15 and axially secured by means of a washer 55 and a retaining ring 56.

The two driving devices 16, 18 are each pivotably hinged via the swivel bearings 57 projecting from the ribs 43 to a lug 58 of a bearing 59. The latter is stationarily mounted in the middle of the link system 13. The driving devices 16, 18 are secured to the lug 58 by means of a washer 60 and a nut 61. When starting the electric motor 45 or 46, the correspondent spindle 50 is rotated and the spindle nut 52 is displaced in the longitudinal direction of the spindle 50, at which the corresponding lever 15 or 17 is displaced.

A programmable computer 62 is provided and connected by means of a cable 63 to the drive motor 7 of the sewing head 4, a cable 64 to the electric motor 31 for the displacement of the workpiece clamp 24, a cable 65 to the electric motor 45 of the first lever 15, and a cable 66 to the electric motor 46 of the driving device 18 of the second lever 17. The electric motors of the driving devices 16, 18 may be actuated by the programmed computer 62 in such a manner, that the workpiece clamp 24 together with the workpiece 3 is displaced linearly on a workpiece supporting plate 67 mounted on the plate 5. An additionally controlled driving of the electric motor 31 causes corresponding swivel movements of the workpiece clamp 24. Finally, a corresponding control of the drive motor 7 of the sewing head 4 performing the sewing operation inclusive the usual functions as thread cutting etc., may be coordinated with the movements of the workpiece 3. As the drive motor 7 and the electric motors 31, 45, 46 are each provided with the already-mentioned pulse generators 12, 32, 48, 49, ecah emitting signals representing the position of the needle 11, or the number of stitches, or swivel position of the workpiece clamp 24, or the positions of the levers 15, 17 to the computer 62, the total system may be considered as a closed loop control circuit.

Figure 6:
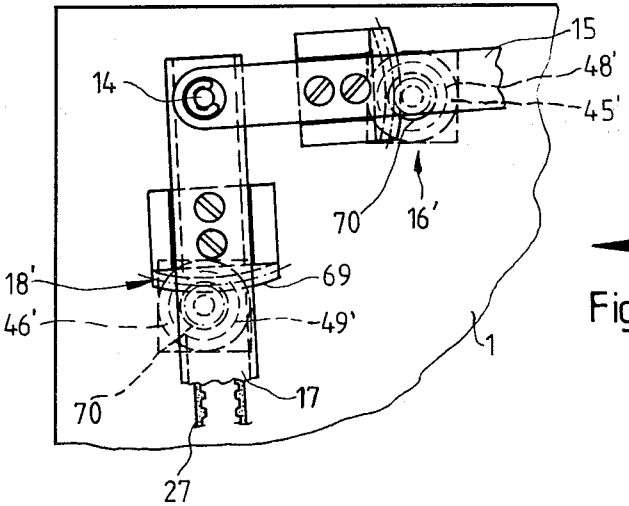
FIG. 6 is a partial top plan view of an embodiment according to the invention showing modified driving arrangements and FIG. 7 is a sectional view of the modified embodiment according to the arrow VII in FIG. 6.
Figure 7:
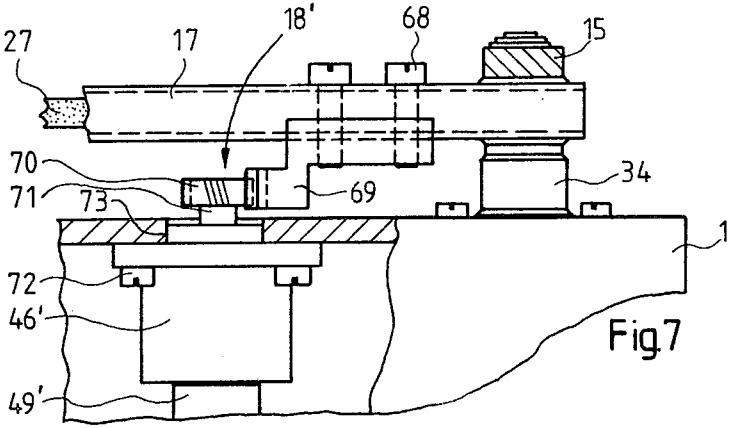

In a modified embodiment as evident from FIGS. 6 and 7, instead of the driving devices 16, 18 also driving devices 16', 18' may engage the first (15) or the second lever 17 and may be provided at the lower surfaces of the levers 15, 17 with toothed segments 69 into which each engages a pinion 70 connected to the shaft 71 of an electric motor 45' or 46'. In this case, the electric motors 45', 46' are secured to the stand 1 by means of screws 72, where the shaft 71 each extends through a corresponding bore 73 of the stand 1. Also here, the electric motors 45', 46' are each provided with a corresponding pulse generator 48' or 49' performing the same functions as described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A sewing machine for producing a stitch contour in a workpiece according to a predetermined program, comprising:

a stand;

a sewing head including a drive motor and received by said stand, and having stitch forming means including a needle;

workpiece receiving means movably arranged in a sewing plane with respect to said needle;

at least one axis located at said stand in a perpendicular extension to said sewing plane, and link means extending in parallel to said plane, including:

a first drive lever pivoted at one end at said axis;

a second drive lever pivoted at one end at said axis;

an intermediate lever jointly connected with one end to the free end of one of said levers;

a drive-off lever jointly connected by link means to the free end of one of said drive levers and to the other end of said intermediate lever and receiving said workpiece receiving means;

propelling means acting upon said drive levers; and programmable control means coordinatingly controlling said propelling means and said drive motor, said propelling means comprising:

a first driving device including a first motor driving said first drive lever; and a second driving device including a second motor driving said second drive lever.

2. A sewing machine according to claim 1, wherein said driving devices are equally structured, each having:

a bracket including a pivot;

a spindle rotatably received in said bracket;

a nut comprising joint means and received on said spindle, and a flange receiving one of said motors said first or said second motor.

3. A sewing machine according to claim 2, wherein said driving device is pivotally connected at said pivot or said joint means to said drive lever or said stand.

4. A sewing machine according to claim 1, wherein said driving devices are equally structured, each installed with gear means comprising:

a pinion drivingly connected to one of said motors and a toothed segment engaging said pinion, one of said gear means being received on said stand.

5. A sewing machine according to claim 2 or claim 4, wherein each of said first and said second motors comprises a stepper motor.

6. A sewing machine according to claim 2 or claim 4, wherein each of said first and said second motors comprises a DC-motor installed with a pulse generator for a closed loop control of said control means.

7. A sewing machine for producing a stitch contour in a workpiece according to a predetermined program, comprising:

a stand;

a sewing head including a drive motor and received by said stand, and having stitch forming means including a needle;

workpiece receiving means movably arranged in a sewing plane with respect to said needle;

at least one axis situated at said stand in a perpendicular extension to said sewing plane and link means extending in parallel to said plane, and including:

a first drive lever pivoted at one end at said axis;

a second drive lever pivoted at one end at said axis;

an intermediate lever jointly connected with one end to the free end of one of said levers;

a drive-off lever jointly connected by link means to the free end of one of said drive levers and to the other end of said intermediate lever and formed at one end with bearing means for pivotally receiving said workpiece receiving means;

propelling means acting upon said drive levers and said rotatable workpiece receiving means, and programmable control means coordinatingly controlling said propelling means and said drive motor, said propelling means comprising:

a first driving device including a first motor driving said first drive lever;

a second driving device including a second motor driving said second drive lever, and a third motor operably connected to said tiltable workpiece receiving means by means of transmitting elements.

8. A sewing machine according to claim 7, wherein said transmitting elements comprises:

a timing belt system having a first timing belt drive connected at one end to said workpiece receiving means;

a second timing belt drive drivingly connected to the other end of said first timing belt drive and to a shaft of said third motor, said timing belt drives each being formed with a 1:1 transmitting ratio and said third motor being fastened to said stand; and a drive connection connecting said first with said second timing belt drive.

9. A sewing machine according to claim 8, wherein said link means connecting said drive-off lever to the free end of one of said drive levers, and said drive connection of said transmitting elements are formed by a common shaft.

10. A sewing machine for producing a stitch contour in a workpiece according to a predetermined program, comprising:

a stand;

a sewing head including a drive motor and received by said stand, and having stitch forming means including a needle;

workpiece receiving means movably arranged in a sewing plane with respect to said needle;

an axis located at said stand in a perpendicular extension to said sewing plane; and link means extending parallel to said plane, and including:

a first drive lever pivoted at one end at said axis;

a second drive lever pivoted at one end at said axis;

an intermediate lever jointly connected with one end to the free end of one of said levers;

a drive-off lever jointly connected by link means to the free end of one of said drive levers and to the other end of said intermediate lever and formed at one end with bearing means rotatably receiving said workpiece receiving means so as to rotate said workpiece in said sewing plane;

propelling means acting upon said drive levers and said rotatable workpiece receiving means; and a programmable computer coordinatingly controlling said propelling means and said drive motor, said propelling means comprising:

a first driving device including a first electric motor driving said first drive lever;

a second driving device including a second electric motor driving said second drive lever, both driving devices being substantially identical, each having a positive drive train;

and a third electric motor having a shaft forming said axis, said third electric motor being fastened to said stand and operably connected to said rotatable workpiece receiving means by a timing belt system having a first timing belt drive connected at one end to said workpiece receiving means;

a second timing belt drive drivingly connected to the other end of said first timing belt drive and to said shaft of said third electric motor, said timing belt drives being each dimensioned with a 1:1 transmitting ratio and said third electric motor being fastened to said stand; and a drive connection connecting said first with said second timing belt drive, said drive connection having a shaft forming said link means.

11. A sewing machine according to claim 10, wherein said first drive lever and said drive-off lever are formed with a hollow profile receiving said timing belt drives.

12. A sewing machine according to claim 11, wherein all of said motors have pulse generators for closed loop control by said programmable computer.

* * * * *